United States Patent [19]

Sheckells

[11] 3,968,595

[45] July 13, 1976

[54] OPERATING AND SPEED CONTROL MECHANISM FOR REVOLVING DOORS

[75] Inventor: Amuel E. Sheckells, Evansville, Ind.

[73] Assignee: International Steel Company, Evansville, Ind.

[22] Filed: Nov. 13, 1974

[21] Appl. No.: 523,415

[52] U.S. Cl. ..... 49/43; 188/185

[51] Int. Cl.[2] ..... E05D 15/02

[58] Field of Search ..... 49/43; 188/185

[56] References Cited

UNITED STATES PATENTS

| | | | |
|---|---|---|---|
| 2,029,318 | 2/1936 | Hagenbook | 49/43 X |
| 3,717,954 | 2/1973 | Sheckells | 49/43 |

*Primary Examiner*—Kenneth Downey

*Attorney, Agent, or Firm*—Brady, O'Boyle & Gates

[57] ABSTRACT

An operating and speed control mechanism for revolving doors features an improved gearing arrangement which makes possible a gear ratio of reduction between the drive motor shaft and door shaft far greater than any gear reduction heretofore attainable, even when using a greater number of gears in the allotted space. Additionally, the improved gear transmission renders the mechanism even more compact than the most favorable prior art arrangements in the interest of satisfying more stringent architectural requirements in the installation of revolving doors. Unexpected benefits provided by the improved and simplified gearing are increased braking efficiency and extra braking force from a small centrifugal brake assembly, and greater and more efficient lubricant circulation in the mechanism for the purposes of brake surface wetting and general lubrication and cooling of the mechanism. A unique mechanism cover plate provides a magnetic flux return path allowing one-half of the permanent magnet motor to be eliminated and thereby rendering the mechanism further compact in its critical vertical dimension.

14 Claims, 3 Drawing Figures

OPERATING AND SPEED CONTROL MECHANISM FOR REVOLVING DOORS

BACKGROUND OF THE INVENTION

Operating and speed control mechanisms for revolving doors have become quite highly developed and sophisticated in the prior art as evidenced by U.S. Pat. Nos. 3,307,660; 3,717,954 and others.

It has consistently been the objective in the prior art to compress these revolving door speed control mechanisms into ever more compact packages, particularly in the vertical dimension in the interest of providing a very low profile for mounting in ceilings. Present day architects are specifying extremely shallow sight lines which require the entire mechanism to be housed within a three inch thick ceiling. In the case of the present invention, the manually operated version is only 1¾ inch thick overall, while the motor-operated embodiment is well under three inches, constituting a marked improvement over the prior art. Similarly impressive dimensional reductions have also been attained in the horizontal plane due to the employment of a more compact gear train and associated elements.

In the present invention, a far greater gear speed reduction between motor shaft and door shaft is attained by the use of fewer gears in a more compact configuration and by means of a cantilevered mounting of a high speed motor-driven pinion relative to an intermediate Evoloid gear having a concave or umbrella-like construction. As a result of this very compact and efficient gearing, certain unexpected benefits for the mechanism have been obtained without addition of parts or other complexities. Among these benefits are an improved flow of lubricant to the friction brake surfaces of the mechanism, apparently due in part to the small diameter of the high speed drive pinion along which the oil may climb toward the centrifugal brake unit and then toward the top cover plate of the mechanism. Because of this improved circulation of lubricant, no auxiliary lubricant pumping means may be employed in the mechanism. Additionally and unexpectedly, an increased degree of braking force has been obtained from the same size brake unit previously employed with lesser braking effect. This is thought to be at least in part the result of decreasing efficiency of the very high speed and high ratio gear train as the load thereon increases and its speed and efficiency decreases gradually. This appears to result in a much greater braking force at the output shaft than could normally be expected from the action of the friction brake shoes alone.

Another great advantage of the invention resides in the employment of a unique magnetic flux permeable cover plate which, in addition to lending structural support to the mechanism at key points, provides a return flux path for the permanent magnet motor which allows elimination of the lower half of the motor with a resulting further reduction in the vertical profile or height of the mechanism.

While the above are among the primary improvement features present in the invention, quite a number of additional important features are also present, only a few of which will now be mentioned.

In terms of the overall structure or mechanism, the following additional features of improvement over the prior art have been obtained:

1. Lower cost both of material purchased and of manufacturing.
2. Higher gear ratio and smallest motor drive known for revolving doors.
3. Mechanism is adaptable to all existing doors either as an overhead drive or floor-mounted, with or without door wing roll aside feature.
4. Lowest known power consumption on any revolving door system.
5. Entire mechanical and electrical system may be mounted in space between ceiling joists for easy adjustment and maintenance.
6. A simplified timing arrangement requires minimum knowledge by field installors or mechanics.
7. Umbrella-shaped intermediate gear in combination with cantilevered high speed pinion allows shallowest manual unit ever produced, allowing architects to specify thinnest sight line with speed control mounted in ceiling, rather than the less desirable floor mounting, where water and dirty environment dictate much more maintenance.
8. More efficient lubricating system allows fuller lubrication with less oil, thereby reducing torque drag caused by oil pumping.

The improved unit cover plate embodies the following features or functions:

1. Serves as a bearing retainer for all shafts which is unique in a revolving door speed control or motor drive.
2. Seals mechanism against oil leaks, water leaks and dirt contamination.
3. Forms a compressive support to carry the load of the door as transmitted through widely spaced dowel pins.
4. Allows eliminating lower half of pancake motor by serving as a return path for magnetic flux during motor operation, and provides an efficient heat sink for the motor.
5. Forms a mounting means for adjustable door timing mechanism and associated reed switch and a mounting means for the door centershaft seal.

The improved gear housing or casting possesses the following features:

1. Smaller size makes possible the adoption of smaller cornices for manual and motor-driven units.
2. Fewer bearing bores significantly reduces machining costs and more castings can be machined per set-up due to smaller size.
3. Marginal contact with cover sheet allows good heat transfer to the entire area of the casting thus promoting motor cooling.
4. Provides unique integration of gear housing and brake mechanism casting, thus eliminating one casting and providing closer alignment of bores without costly dowel pinning required in two-part assemblies.
5. Contains extended brake mechanism bore for inexpensive efficient oil return path to reservoir, by way of intermediate gear which in turn lubricates main bull gear. The intermediate gear also slings oil in all directions for heat transfer to all heat sink areas of mechanism.

Features of improved gearing:

1. Extremely compact gear train with highest gear ratio produced by only two gears and two pinions.
2. Intermediate umbrella gear serves as medium torque drive gear, bearing mount, oil slinger, oil pumper and circulator for lubricating and cooling purposes.

The high speed pinion and its shaft forms a low torque high speed drive means, and constitutes a mounting means for bearings, brake mechanism, motor and clutch.

Other detailed features and advantages of the invention while not specifically mentioned here will become apparent during the course of the following detailed description.

BRIEF DESCRIPTION OF DRAWING FIGURES

DETAILED DESCRIPTION

Figure 2:
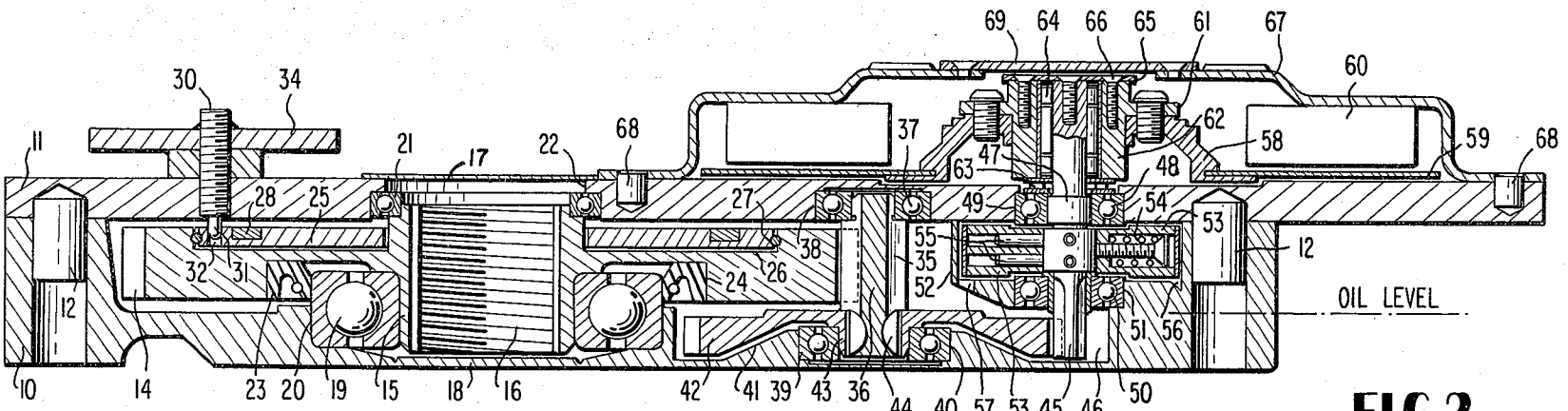
FIG. 2 is a vertical section taken on line 2—2 of FIG. 1.

Referring to the drawings in detail wherein like numerals designate like parts, the mechanism comprises a unitary gear housing 10 in the form of a casting having a thin or low profile configuration apparent in FIG. 2. A sturdy cover plate 11 of substantial rigidity is accurately located on the top marginal face of the housing 10 by a pair of widely spaced dowel pins 12, the cover plate being secured to the underlying housing 10 at a number of different points around the margin of the assembly by cap screws 13 or the like. The abutting faces of the housing and cover plate are preferably sealed in assembly by a conventional sealant.

Within the housing 10 and beneath the cover plate 11 and spanning a major portion of the housing is a main or bull gear 14 having a hub 15 which is internally threaded at 16 for the reception of either a depending stub shaft similar to the shaft 2 in FIG. 2 of U.S. Pat. No. 3,717,954, or an upstanding stub shaft, or revolving door shaft, as indicated at 3 in U.S. Pat. No. 3,307,660. In this connection, the invention is readily adaptable to both types of mounting, that is, overhead or ceiling mounting of the mechanism or floor mounting, both types being well known in the prior art. For simplicity and ease of illustration, no particular form of mounting of the mechanism is shown in the drawings and therefore neither a stub shaft or continuous revolving door shaft is shown, it being clearly understood that the mechanism can readily accept either conventional form of shaft or mounting by direct connection with the threaded hub of the bull gear 14. In FIG. 2, a removable temporary decal cover for the bore of bull gear 14 is provided at 17, and a thin knock-out plate section 18 is also provided in the bottom wall of housing 10 which is removed in all overhead installations.

The main or bull gear 14 is held in the inner race of a relatively large ball bearing 19 whose outer race is received in a recess or seat 20 of the housing 10. A second smaller ball bearing 21 seated in a recess formed in the bottom of cover plate 11 stabilizes the upper end of the main gear hub 15 as shown in FIG. 2. The cover plate 11 has a clearance opening 22 adjacent the bearing 21 and gear hub for a revolving door shaft, not shown. An annular seal 23 is intervened between the outer race of ball bearing 19 and the main gear 14 and is held within a recess 24 provided in the bottom of main gear 14.

A non-magnetic holder plate 25 is held within an upper recess 26 of main gear 14 by a marginal O-ring 27 or the like, and the holder plate is also recessed in its top face to hold an arcuate interrupted permanent magnet strip 28. The magnetic field of the strip 28 coacts with a magnetic reed switch 29 embedded in the cover plate 11 to initiate and terminate the powered cycle of operation of the revolving door. This arrangement and mode of operation is disclosed in prior U.S. Pat. No. 3,497,997.

Improved means is provided to adjust or time the revolving door so that it will always stop on a quarterline following termination of its powered operation. This means comprises a manual screw detent 30 carried by the cover plate 11 having a detent tip 31 adapted to enter selectively one of a series of spaced adjustment openings 32 in the holder plate 25. In practice, to adjust or time the revolving door for accurate quarterline positioning, the detent 30 is turned until the tip 31 enters and interlocks with an opening 32, following which the door is moved to the quarterline position. This operation will cause the main gear 14 to revolve relative to the plate 25 which is held stationary by the detent means during the adjustment or timing. The detent screw is then backed off to retract the tip 31 from opening 32, and a stop element 33 on the cover plate 11 which overlaps the head 34 of the screw detent limits the retraction of the screw so that the parts will not be separated. In practice, the detent is merely backed off following the adjustment until the head 34 touches the stop element 33.

In lieu of this mechanical timing means, an electromechanical means, such as a solenoid-operated detent plunger, could be employed to operate the tip 31.

A secondary or intermediate pinion 35 is arranged in mesh with the main gear 14, and this pinion includes an integral shaft 36 extending above and below the gear teeth of the pinion and of the main gear. The upper extremity of pinion shaft 36 is held within a ball bearing 37, and this upper bearing is disposed in a bearing receiving recess 38 in the lower face of cover plate 11.

A lower ball bearing 39 is mounted within a recess 40 in the bottom wall of housing 10 and this recess is produced in a rising upwardly tapering conical boss 41 of the housing spaced laterally of the bearing recess 20. A computer designed intermediate Evoloid gear 42, capable of producing the extremely high speed reduction required between the motor shaft and revolving door shaft such as 340:1, has a short hub 43 engaging within the inner race of ball bearing 39 and keyed at 44 to the lower extremity of pinion shaft 36. The Evoloid gear 42 has an umbrella-like configuration to enable it to interfit with the boss 41 in assembly for the sake of achieving the lowest possible profile in the mechanism. The gear 42 closely underlies the main gear 14, FIG. 2, in a very compact configuration.

A motor-driven high speed pinion 45 is arranged in mesh with the intermediate Evoloid gear 42 in an oil sump 45 of the housing 10 surrounding the tapered boss 41. The high speed pinion 45 has an integral shaft 47 supported in an upper ball bearing 48 held within an opening 49 of cover plate 11. A lower ball bearing 50 supports the high speed pinion shaft immediately above the active gear teeth thereof and this lower bearing is held within an elevated recess 51 of the housing 10, slightly above the plane of the gear 42.

The integral means on the housing 10 within which the bearing recess 51 is formed also provides a drum structure 52 to resist radial expansion of opposed centrifugal force operated brake shoes 53 which are normally biased to inactive positions by coil springs 54, the brake shoes 53 being guided by pins 55. The centrifugal brake assembly turns with the high speed pinion shaft 47 inside of the drum 52 integrally formed with housing 10. The brake assembly and its mode of operation is substantially disclosed in U.S. Pat. No. 3,717,954 and per se is conventional and need not be further described. The centrifugal brake assembly and surrounding coacting drum 52 terminate at the top face of housing 10 in laterally spaced relation to the intermediate pinion 35 to further achieve the lowest possible profile for the mechanism.

An oil return groove 56 is provided in the housing 10 immediately below the brake shoes 53, such return groove delivering oil at 57 onto the intermediate gear 42 where the groove opens through the housing structure which supports the bearing 50. Thus oil from the sump 46, which creeps upwardly along the high speed pinion shaft, is enabled to properly wet the brake shoe linings and then to return downwardly toward the sump 46.

It should also be noted that the high speed pinion 45 is cantilevered dependingly from its support bearings and projects into the oil sump 46 adjacent the umbrella-like Evoloid gear 42, thus promoting the extreme compactness of the mechanism.

The high speed pinion 45 is driven by an extremely low profile permanent magnet pancake motor having a half rotor 58 whose lower end carries a thin laminated rotor plate 59 immediately above cover plate 11 and immediately below the motor permanent magnet means 60. The half rotor 58 is connected through an adapter 61 to a rotor hub 62 which rests on a suitable thrust bearing 63 above ball bearing 48. A one-way active mechanical clutch 64 is contained within the rotor hub 62 in driving engagement with the upper end portion of high speed pinion shaft 47. This overrunning clutch allows the motor driven door to be converted to manual operation simply by turning off the power to the motor. The rotor 58 will not turn when the power is off although the door is being driven manually. A similar overrunning clutch arrangement is disclosed at 23 in FIG. 10 of U.S. Pat. No. 3,717,954 and for this reason a further detailed description of the clutch is unnecessary.

A motor hub retainer 65 at the top of the hub 62 is secured thereto by screws 66. A low profile motor half housing section 67 covers the top of the motor assembly and is fixedly secured to the top of cover plate 11 and positioned thereon by a pair of diametrically spaced locator dowel pins 68. The half housing 67 also has a removable top plate 69 for convenience.

A unique feature of the invention allows the entire lower half of the permanent magnet motor to be omitted in the assembly, thus greatly minimizing its thickness or profile. This is possible because a return path for the magnetic flux passing through the thin rotor plate 59 is afforded by the magnetically premeable cover plate 11 of the invention.

Figure 1:
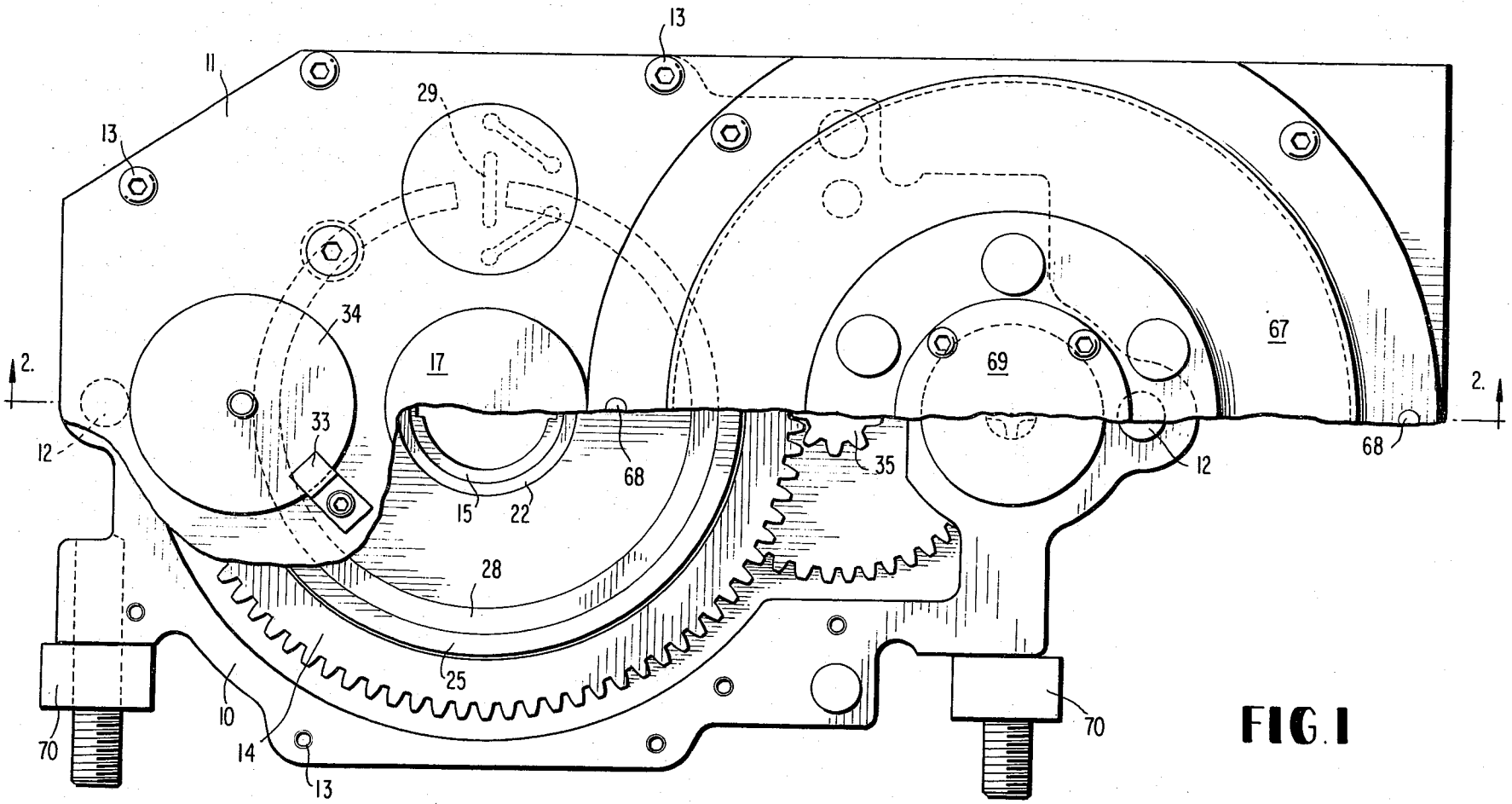
FIG. 1 is a plan view of a revolving door operating speed control mechanism is accordance with the invention.

As shown in FIG. 1, the housing 10 is equipped with conventional anti-vibration mounting bolts 70 substantially of the type indicated at 46 in U.S. Pat. No. 3,307,660.

The general mode of operation of the speed control mechanism and power drive means is well known and described in the prior art patents and need not be repeated in detail herein. Suffice it to say that when the door is manually engaged in the quarterline stopped position and revolved slightly, the coaction of the magnet strip 28 and reed switch 29 will initiate the operation of the electric motor whose rotor 58 will drive the high speed pinion 45 through the clutch 64, and through the Evoloid gear 42, intermediate pinion 35 and main or bull gear 14, the revolving door center shaft means will be driven. The centrifugal brake assembly including shoes 53 and stationary drum 52 will operate in a well known manner to control and limit the speed of the door at all times. When the user or users of the door have passed through, the door will stop automatically at the quarterline position, again by the interaction of elements 28 and 29.

However, an unexpected bonus feature of the invention resides in a significant degree of increased braking force well beyond that which could be expected normally from the two friction shoes 53. It is believed that this increased brake efficiency is a by-product of the extra high speed and high efficiency gear train, particularly the high speed pinion 45 and associated Evoloid gear 42. When normal braking begins to take place, responsive to centrifugal force acting on the shoes 53, the speed of the entire gear train is diminished and its efficiency at lower speeds is greatly diminished, resulting in greater resistance to turning at these speeds with the net effect that increased braking force is obtained without increasing the size of the friction brake assembly or brake shoes. Therefore, the very inefficiency feature of the gearing at reduced speeds is turned into an advantage in the production of unexpectedly increased braking efficiency or force which is a highly desirable feature, seemingly inherent in the invention. This unexpectedly high degree of braking achieved in the invention renders it unnecessary to adopt substantially higher cost materials for the centrifugal brake assembly which were thought to be necessary to obtain desirable increased braking. Thus, an unexpected saving in material cost has also been achieved.

Another very important operational improvement of the invention resides in the low volume, high efficiency oil circulating system for the mechanism which efficiently lubricates the gearing and wets the brake shoe linings while also cooling vital parts. The necessity for special oil pumping means in the mechanism is fully avoided. In this connection, it is believed that the very small diameter of high speed pinion 45 lessens the tendency for oil to be thrown therefrom by centrifugal force, allowing the oil to migrate upwardly along the high speed pinion and its shaft to wet the brake shoe surfaces and then return via the groove 56 onto the intermediate gear 42 which slings oil in the housing chamber to thoroughly lubricate other parts including pinion 35 and main gear 14.

Additionally, the cover plate 11 forms a highly efficient heat sink to carry away heat from the electric motor, and due to its large area spanning the entire mechanism, its efficiency in this respect is further increased. The cover plate is in contact with the housing or casting 10 around the entire margin of the latter to distribute heat evenly. The continuous circulation of oil in the housing also carries heat to all points, evenly distributing it for rapid transfer to the atmosphere. Oil flow in the system against the hottest part of the cover plate 11 directly below the motor provides the motor with a liquid cooled radiator simulating engine cooling by liquid means. Other advantages inherent in the improved construction will be apparent to those skilled in the art without a further lengthening of the present description.

Figure 3:
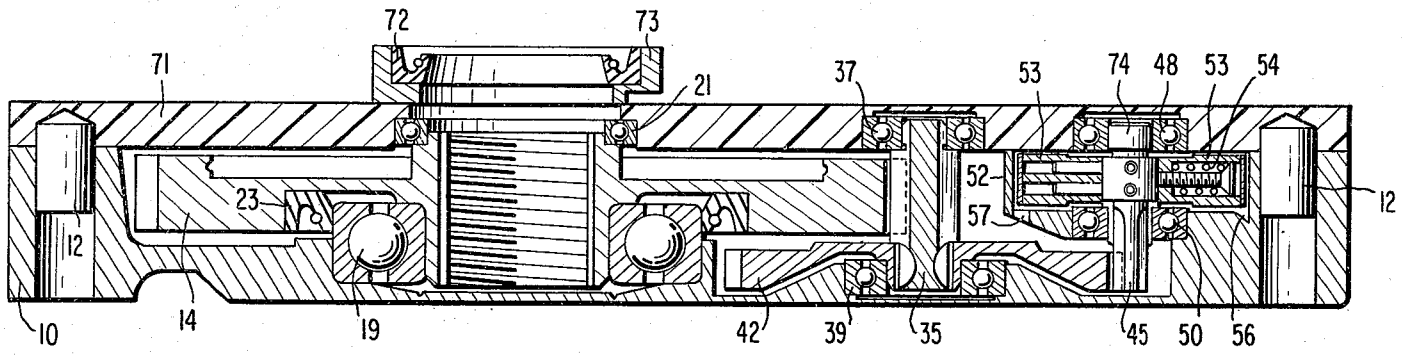
FIG. 3 is a similar cross section showing a modified form of the invention embodied in a manually operated speed control mechanism.

FIG. 3 of the drawings depicts a modification of the invention in which the basic door operating and speed control mechanism shown in FIG. 2 is utilized without a drive motor and associated electrical controls and timing means for manually operating a revolving door. As shown in FIG. 3, the identical mechanism housing 10 of the power-operated embodiment is utilized along with a somewhat modified cover plate 71 which may be formed of phenolic material to reduce cost considerably in comparison to the mild steel cover plate 11 required for the motor-driven unit in order to provide a flux return path. The manual unit embodies the identical main door drive gear 14, support bearing 19, intermediate Evoloid gear 42, intermediate pinion 35, support bearings 37 and 39, high speed pinion 45, bearings 48 and 50, and the same centrifugal brake means 52-53 described in the previous embodiment. A door shaft seal 72 and seal holder 73 are also illustrated in FIG. 3 for a typical floor-mounted installation. In FIG. 3, the electric motor and clutch along with the holder plate 25, magnet strip 28 and detent means 30 necessary for the powered mechanism are all eliminated. The resulting assembly has an extremely lower profile not exceeding 1¾ inches in vertical thickness, and nothing equalling this compactness has heretofore been achieved in the known prior art. Again, the compactness or thinness of the manually-operated speed control mechanism is made possible, as in the power-driven device, by the particular arrangement of the umbrella-like Evoloid gear 42 and the depending cantilevered high speed pinion 45 having one support bearing in the housing 10 and a second bearing 48 in the cover plate 71. In the manual unit, the high speed pinion shaft 74 is foreshortened at the top, terminating within the bearing 48, as there is no necessity for a top extension on this shaft to receive the hub and clutch of the motor rotor, as depicted in FIG. 2.

Nevertheless, it should also be understood that the electric motor of the powered unit in FIG. 2 and associated control means 28 and 29 could simply be removed, retaining the same cover plate 11, allowing the upper portion of high speed pinion shaft 47 to project above the cover plate. This would allow the mechanism in FIG. 2 to operate manually, while making the unit readily adaptable to a motor drive where needed. Thus, the basic components of the mechanism common to both the powered and manual units remain the same in both units, and the invention is quite flexible in terms of adaptability to existing and new door installations, both manual and powered, with both overhead and floor mountings of the speed control or drive mechanisms.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A low profile operating mechanism for revolving doors comprising a shallow top opening mechanism housing and a cover plate for said housing attached to the top thereof and spanning and covering the open top of the housing, a main revolving door drive gear and gear support bearing means within the housing and beneath the cover plate, an intermediate pinion within the housing in mesh with said main gear and having a top support bearing in said cover plate, an umbrella-like Evoloid gear within the housing beneath the main gear and being fixed to the intermediate pinion near the bottom of the housing and having a hub, a lower support bearing in the bottom of the housing receiving and supporting the Evoloid gear hub and also supporting the intermediate pinion which is affixed to the Evoloid gear, a high speed pinion within the housing in mesh with the Evoloid gear, a shaft carrying the high speed pinion and extending thereabove, an upper support bearing for the high speed pinion shaft on said cover plate, a lower bearing for the pinion shaft within said housing above the Evoloid gear, whereby the high speed pinion is cantilevered below said lower bearing for the high speed pinion shaft, and a centrifugal friction brake assembly secured to the high speed pinion shaft and turning therewith relative to the stationary brake drum within the tip portion of the housing and being formed integral therewith and integral with a seat for said lower high speed pinion shaft.

2. A low profile operating mechanism for revolving doors according to claim 1, and an upwardly tapering boss on the bottom of the housing beneath said umbrella-like Evoloid gear and interfitting with the gear so that the teeth of the gear may be positioned close to the bottom of the housing in surrounding relation to the hub of the Evoloid gear, said boss having a retainer recess for said lower support bearing receiving and supporting the Evoloid gear hub, the formation of said boss providing an oil chamber surrounding said boss in the bottom of the housing and the teeth of the Evoloid gear and of the high speed pinion operating within said oil chamber.

3. The structure of claim 2, and said seat for said lower bearing for said pinion shaft having a marginal upwardly opening return groove for oil and said groove opening through said seat directly above said Evoloid gear to direct lubricating oil onto the same during operation of said mechanism.

4. A low profile operating mechanism for revolving doors according to claim 1, and an electric drive motor rotor connected with the high speed pinion shaft above said cover plate and including a thin rotor plate extension lying close to the top face of the cover plate, the cover plate being magnetically permeable and forming a return path for magnetic flux passing through the thin rotor plate extension from magnet means above the cover plate.

5. The structure of claim 4, and a motor housing covering said rotor above said cover plate and being attached to the top of the cover plate, said magnet means consisting of a permanent magnet attached to the motor housing and disposed immediately above said thin rotor plate extension.

6. The structure of claim 4, and said rotor including a rotor hub surrounding the high speed pinion shaft, and an overrunning clutch within the hub and operatively engaged with said high speed pinion shaft to turn the same in one direction.

7. The structure of claim 4, and control and timing means for said rotor including a magnetic flux responsive switch mounted on the cover plate, and a coacting arcuate magnetic strip secured to said main drive gear and turning therewith, said switch being in the path of movement of said strip and being electrically coupled to said drive motor.

8. The structure of claim 4, and said drive motor comprising a permanent magnet drive motor.

9. The structure of claim 7, and a non-magnetic carrier element for said magnet strip attached to said main drive gear and having at least one adjusting opening, and an adjustable detent means on said cover plate including a detent tip movable into interlocking engagement with said adjusting opening, whereby said carrier element can be locked for relative movement with the main drive gear when the latter is turned in response to positioning a revolving door at a quarter-line position.

10. The structure of claim 9, and said detent means comprising a manual detent screw having threaded engagement with said cover plate, and a positive stop element on the cover plate in the path of movement of said screw and stopping the retraction of the screw when said detent tip is fully withdrawn from said adjusting opening.

11. A low profile operating mechanism for revolving doors comprising a housing and a cover plate for the top of the housing and being attached to the marginal portion of the housing, a main revolving door drive gear journaled within the housing beneath the cover plate, an intermediate pinion journaled within the housing and being in mesh with the main drive gear and having a top support bearing in said cover plate, an intermediate low profile high reduction gear secured to the intermediate pinion to drive the latter and positioned near the bottom of the housing, a lower support bearing in the bottom of the housing supporting said intermediate low profile high reduction gear and being substantially contained in the plane of said intermediate low profile high reduction gear, a high speed pinion shaft journaled within the housing and including a lower end cantilevered high speed pinion in mesh with said intermediate high reduction gear, an upper support bearing for the high speed pinion shaft on said cover plate, and a centrifugal brake assembly and an electric motor drive rotor coupled with said high speed pinion shaft in stacked relation thereon above said cantilevered high speed pinion and said intermediate high reduction gear whereby said main revolving door drive gear said intermediate pinion and said centrifugal brake assembly are contained within a first horizontal plane immediately above a second horizontal plane containing said intermediate low profile high reduction gear and said high speed pinion.

12. The structure of claim 11, and said high speed pinion shaft extending above said cover plate, said motor drive rotor coupled with siad high speed pinion shaft above said cover plate and exteriorly of said housing.

13. The structure of claim 12, and an inverted cup-like housing for said drive rotor covering the drive rotor and being attached to the top of said cover plate.

14. The structure of claim 11, and said high reduction gear having an umbrella-like formation and being disposed close to the bottom of the housing, the housing including an upwardly tapering boss adjacent to the high reduction gear projecting into a bottom cavity of such gear, said lower support bearing connected in said boss and projecting into the bottom cavity of said high reduction gear, and the housing having an oil chamber surrounding said boss and within which the teeth of the high reduction gear and said high speed cantilevered pinion operate.

* * * * *